US011970918B2

(12) United States Patent
Akselberg

(10) Patent No.: US 11,970,918 B2
(45) Date of Patent: Apr. 30, 2024

(54) PULLING TOOL

(71) Applicant: WELL INNOVATION AS, Sandnes (NO)

(72) Inventor: Frank Ove Akselberg, Sandnes (NO)

(73) Assignee: WELL INNOVATION AS, Sandnes (NO)

( * ) Notice: Subject to any disclaimer, the term of this patent is extended or adjusted under 35 U.S.C. 154(b) by 0 days.

(21) Appl. No.: 18/007,941

(22) PCT Filed: May 25, 2021

(86) PCT No.: PCT/NO2021/050131
§ 371 (c)(1),
(2) Date: Dec. 2, 2022

(87) PCT Pub. No.: WO2021/246875
PCT Pub. Date: Dec. 9, 2021

(65) Prior Publication Data

US 2023/0235637 A1 Jul. 27, 2023

(30) Foreign Application Priority Data

Jun. 3, 2020 (NO) ..... 20200652

(51) Int. Cl.
*E21B 23/00* (2006.01)
*E21B 23/04* (2006.01)
*E21B 47/12* (2012.01)

(52) U.S. Cl.
CPC ..... *E21B 23/001* (2020.05); *E21B 23/04* (2013.01); *E21B 47/12* (2013.01)

(58) Field of Classification Search
CPC ..... E21B 23/14; E21B 23/001; E21B 23/00; E21B 23/04; E21B 47/12
See application file for complete search history.

(56) References Cited

U.S. PATENT DOCUMENTS 4,862,808 A * 9/1989 Hedgcoxe ..... B62D 61/10 105/365
6,273,189 B1 8/2001 Gissler
(Continued)

FOREIGN PATENT DOCUMENTS

CN 107255205 8/2019
KR 200479032 12/2015
(Continued)

OTHER PUBLICATIONS

Search Report mailed in corresponding NO 20200652 dated Dec. 11, 2020 (2 pages).
(Continued)

*Primary Examiner* — George S Gray
(74) *Attorney, Agent, or Firm* — Wissing Miller LLP

(57) ABSTRACT

The present invention concerns a drive module (10', 10", 10"', 10"") for a wellbore tractor (1). Each drive module (10', 10", 10"', 10"") comprises a drive module housing (13) and a hydraulically actuated and pivoting drive unit (11) comprising an arm housing (11') and two drive wheels (12', 12") arranged thereto. The drive wheels (12', 12") are driven by a motor (16) mounted inside the arm housing (11'). The drive wheels (12', 12") are drivingly connected to the motor (16) via a drive line comprising a worm gear drive arrangement (14). The invention teaches also a wellbore tractor (1) comprising at least one of said drive modules (10', 10", 10"', 10"").

14 Claims, 4 Drawing Sheets

(56) References Cited

U.S. PATENT DOCUMENTS

| | | | | |
|---|---|---|---|---|
| 2002/0190682 | A1* | 12/2002 | Schempf | G01N 29/265 318/568.11 |
| 2011/0185806 | A1* | 8/2011 | Pfutzner | G01V 7/06 73/382 R |
| 2015/0300113 | A1* | 10/2015 | Guttormsen | E21B 4/18 166/243 |
| 2019/0048976 | A1* | 2/2019 | Armstrong | F16H 1/222 |
| 2019/0316433 | A1* | 10/2019 | Schroit | F04B 53/00 |

FOREIGN PATENT DOCUMENTS

| | | |
|---|---|---|
| WO | 2002070943 | 9/2002 |
| WO | 2006115418 | 11/2006 |
| WO | 2014081305 | 5/2014 |
| WO | 2015115904 | 8/2015 |
| WO | 2019009734 | 1/2019 |

OTHER PUBLICATIONS

International Search Report and Written Opinion mailed in corresponding PCT/NO2021/050131 dated Aug. 16, 2021 (8 pages).

* cited by examiner

PULLING TOOL

CROSS-REFERENCE TO RELATED APPLICATIONS

This application is a 371 of PCT/NO2021/050131 filed on May 25, 2021, published on Dec. 9, 2021 under publication number WO 2021/246875 A1, which claims priority benefits from Norwegian Patent Application No. 20200652 filed Jun. 3, 2020, both of which are incorporated herein in their entirety by reference.

BACKGROUND OF THE INVENTION

Wellbore tractors are commonly used for conveying different equipment into a wellbore. Several types of designs for such machines exists. Typically, the wellbore tractors have driving wheels or belts, and the propulsion force is provided by mechanical interaction between the wheels or belts and the wellbore inner wall. The required power to the wellbore tractor is normally provided by means of a cable connection to the surface, wherein the length of the cable is often several kilometers and therefore represents a substantial power loss as a function of the magnitude of the transferred electrical power.

The power consumption of the wellbore tractor will therefore be of importance as the transferable power to the tractor is limited. Preferably, the efficiency of the tractor should be equal or better at higher speeds vs. lower speeds. Most known wellbore tractors utilize electric-hydraulic operation for propulsion. This means that an electric motor drives a hydraulic pump, which again supplies power to a hydraulic motor connected to the driving wheels or belts. Besides being relatively technically complex, an electric-hydraulic drivetrain system will normally be expected to have lower efficiency at increasing or higher speeds due to increasing hydraulic frictional losses internally in the drive system. An all-electric drivetrain type wellbore tractor will naturally not experience this type of hydraulic losses and therefore will have the potential to achieve substantially higher efficiencies than an electric-hydraulic type, especially at higher speeds.

A practical consideration would be, since energy supply is limited, that the highest drivetrain efficiency is most important at higher speeds, thereby enabling higher speeds at the same pull force.

Yet another beneficial property of all-electric drivetrain is that the speed and torque can be controlled independently. This enables both good and independent speed and traction control and ability to synchronize the rotational speed of all the drive wheels of the system over the full speed range.

SUMMARY OF THE INVENTION

It is therefore an object of the invention to provide substantially higher efficiency performance for a wellbore tractor, also at higher speeds.

Another object of the invention is to enable a robust, simple and service friendly drivetrain system in order to reduce maintenance complexity and operational costs.

Yet another object of the invention is to meet, in a simple and robust way, the functional requirements for a wellbore tractor, regarding handling of restrictions, sharp curvatures or other obstacles without getting stuck and/or losing traction.

According to one aspect of the invention, this is achieved by a wellbore tractor as described and specified in this publication.

According to another aspect of the invention, this is achieved by a drive module as described and specified in this publication.

The main features of this invention are given in the independent claims. Additional features of the present invention are given in the dependent claims.

A drive module for a wellbore tractor comprises a drive module housing and a drive unit. The drive unit is arranged into the drive module housing to have at least one of its two connected drive wheels engage the wellbore inner diameter in a pivotal movement by means of a hydraulic actuator also connected to the drive module housing. The drive unit contains the whole drivetrain of the drive module, from the motor to the drive wheels. The two drive wheels are further installed into the drive unit in such way that they may be replaced without breaking the tools fluid barrier/seals. The drive wheels are drivingly connected to the motor via a worm gear drive line, and as necessary, depending on motor performance, an additional reduction gear to provide required torque to the worm gear.

The present invention teaches a drive module for a wellbore tractor, where the drive module comprises a drive module housing and pivoting drive unit, which can be hydraulically actuated. The drive unit comprises an arm housing and two drive wheels arranged thereto. The drive wheels are driven by a motor. The motor is mounted inside the arm housing. The drive wheels are drivingly connected to the motor via a drive line. The drive line comprises a worm gear drive arrangement. The worm gear drive arrangement comprises a worm gear and a worm wheel. The worm gear drive arrangement, and particularly the worm wheel thereof, is arranged between the two drive wheels.

The drive line arrangement can comprise a reduction gear. The reduction gear can be a planetary reduction gear.

The drive module can further comprise a hydraulic actuator. The hydraulic actuator provides for manipulation of the drive unit pivoting position relative to the drive module housing.

The contact force of any one or both drive wheels against the casing or pipe or borehole can be adjustable, for obtaining a required or desired traction. This can be done by manipulating or changing the pressure of the hydraulic actuator.

The present invention teaches also a wellbore tractor comprising at least one of said drive modules.

The wellbore tractor can further comprise at least one of: a hydraulics module, an electronics module, a top end module and/or a bottom end module.

The electronics module can comprise at least one of: a power supply unit, a telemetry unit, a motor controller unit and/or a tractor controller unit.

The hydraulics module is used for operating the hydraulic actuator providing for manipulating or changing the position of the drive wheels and/or drive unit of the drive module with respect to the drive module housing and/or to the wellbore inner wall.

Each pair of drive wheels and/or motor can be controlled and/or operated independently.

Each drive unit can be individually retracted and/or extended.

All installed mechanically independent drive modules can communicate together in order to synchronize rotation, speed, position, torque, force and/or other characteristics for one drive wheel pair with all the other drive wheel pairs thereof.

All drive units in the drive modules thereof can have a predetermined angle or degree offset from each other, viewed in a section being perpendicular to the longitudinal axis of the well tractor.

DETAILED DESCRIPTION OF THE EMBODIMENTS

In the present invention the drivetrain function is provided without any use of hydraulics. Thereby a substantially higher performance than the performance of an electric-hydraulic drivetrain type wellbore tractor, is achieved for this all-electric drivetrain type wellbore tractor, especially at higher speeds.

A wellbore tractor should be designed to be able to negotiate different restrictions, sharp curvatures and/or other obstacles without getting stuck and/or losing traction. In order to achieve these important or required functions, a solution has been provided in the present invention, thus making it possible to meet said functional requirements in a simple and robust way.

Figure 1:
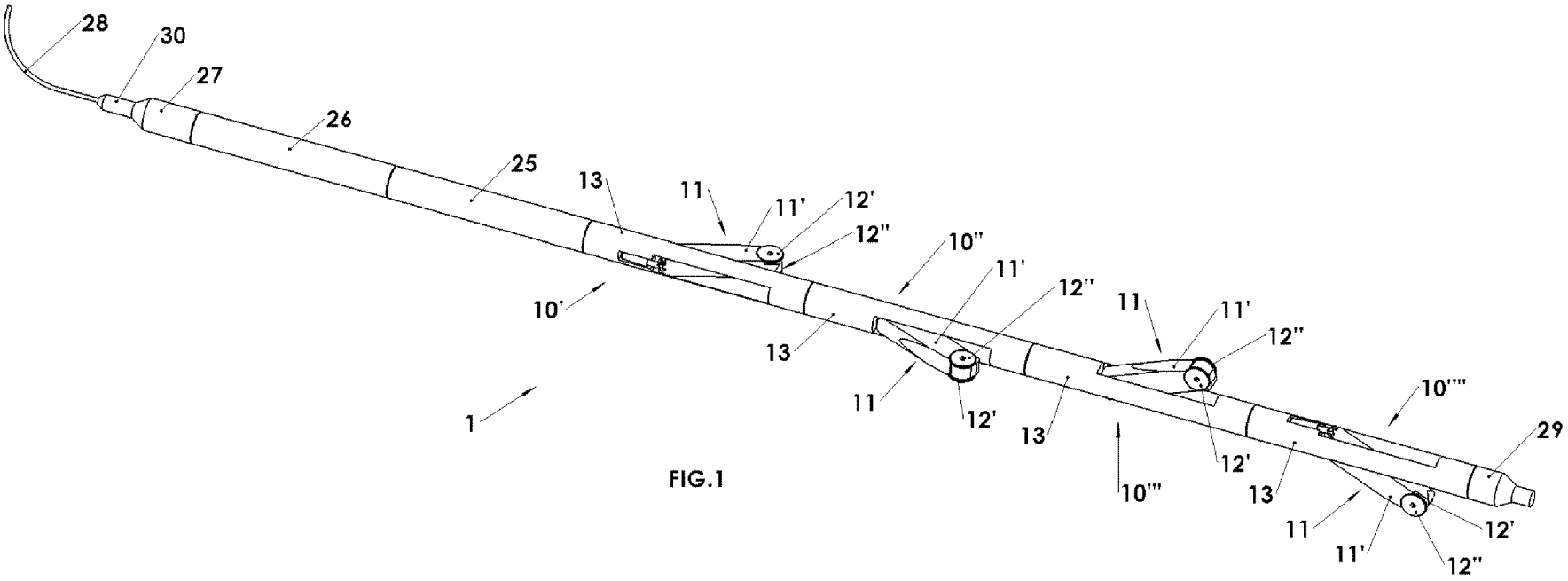
FIG. 1 shows in perspective one embodiment of a wellbore tractor according to the present invention.

FIG. 1 shows, in perspective, one embodiment of a wellbore tractor 1 according to the present invention. In this embodiment the wellbore tractor 1 is shown comprising four drive modules 10', 10", 10''', 10'''', one hydraulics module 25 used only for extracting or retracting a drive unit 11 of the drive module 10', 10", 10''', 10'''', one electronics module 26, a near or top side or end module 27 and a far or bottom side or end module 29, wherein the near or top side or end of the wellbore tractor 1 can be defined as the wellbore tractor 1 end being closer to the place where the wellbore tractor 1 entered the borehole or pipeline, than the other wellbore tractor 1 end, which is being defined as the far or bottom side or end of said wellbore tractor 1. A tension sub (not shown) for cable tension monitoring can be positioned at the top end of wellbore tractor 1. This tension sub can be used to prevent the wellbore tractor 1 from running over the cable 28 during reverse operation. The tension sub can presumably be arranged or placed in the cable fastening point 30 at top of the wellbore tractor 1, or for example in the top side module 27, also called as (upper) UMT (user module top) 27. The drive unit 11 comprises an arm housing 11' and two drive wheels 12', 12" arranged thereto.

Centralization module(s) can presumably be required in order to stabilize the wellbore tractor 1 at the center of a casing or pipe, and can presumably be arranged or placed as or in the top side module or UMT 27. With this construction/design it can be achieved that the wellbore tractor 1 should always be kept centered within a pipe or borehole or casing. This is a condition for allowing efficient positioning of equipment and/or operation of measuring tool(s), etc.

Each drive module 10', 10", 10''', 10'''' comprises at least one drive unit 11, and this embodiment of the wellbore tractor comprises four drive modules 10', 10", 10''', 10''''. Higher number (than four) of drive modules 10', 10", 10''', 10'''' can also be possible. Lower number (than four) of drive modules 10', 10", 10''', 10'''' in the wellbore tractor 1 can be possible too. Each drive module 10', 10", 10''', 10'''' can further comprise a motor controller or MC module (not shown).

One desired design of the wellbore tractor 1 comprises four drive modules 10', 10", 10''', 10'''' each with 90°, 180° and 270° degrees angle of one drive unit relative to other drive units viewed in a section perpendicular to the longitudinal axis of the wellbore tractor 1. Of course, other suitable angles should be possible (such as, but not limited to, e.g. 120° and 240° degrees offset from each other, etc.).

The electronics module 26 can comprise at least one of: a power supply unit, a telemetry unit, a motor controller unit and/or a tractor controller unit.

The power supply unit can provide stable and ample power (voltage and/or current) from the cable/wire 28 line to the other units in the tractor 1, such as, but not limited to, e.g. the electronics module 26. It can also protect those other units from overload/overvoltage, which could damage them.

The telemetry unit can provide a communication means with the surface in order to be able to, but not limited to, send e.g. control command(s) to the tractor 1 and/or receive e.g. status information from the tractor 1 during various operations and/or standby and/or idle states.

The motor controller unit can control the (electrical) motor 16 and report motor status, such as, but not limited to, motor speed, direction, motor torque, motor power consumption and/or motor temperature. It can also be able to protect the motor 16 from for example overload and/or other failure situations.

The tractor controller unit can control all functions in the tractor 1, such as, but not limited to, the tractor/motor speed, direction and/or torque settings, the hydraulics module 25 operation and status information and/or power consumption. It can interpret for example the command(s) received from the surface, act accordingly and send status information, via e.g. the telemetry unit. It can also protect the tractor 1 from for example overload and/or other failure situations. The tractor controller unit could also communicate and control additional payload module(s) and optionally interpret information received therefrom.

The hydraulics module 25 can be used for e.g. operating or actuating a hydraulic actuator, e.g. a hydraulic cylinder, providing for manipulating or changing the position of a drive unit/wheel of a drive module 10', 10", 10''', 10'''' with respect to a drive module housing 13 and/or to the wellbore inner wall (not shown). The hydraulics module 25 can comprise a pressure compensation chamber against the well and a volume expansion chamber. Moreover, it comprises an electric motor and a pump as well as a valve system and (pressure) sensor(s) in order to operate and/or control the hydraulic actuation of each drive unit 11. The motor, pump and valve system are being controlled, e.g. electronically, by a controller (unit) in the electrical or electronics module 26.

The far or bottom side or end module 29 can be used as an interface for payload module(s) that can be connected or coupled thereto, wherein a payload module can be e.g., and is not limited only to, a tool or equipment that is to be carried and operated in the well or pipe, such as e.g., but not limited to, anchors, actuators, mills/stampers, logging equipment, etc.

Several control systems and additional modules can be integrated in or connected to the wellbore tractor 1, when or if needed or necessary, in order to e.g. monitor different/various functions and/or operations of the wellbore tractor 1 and/or its units and/or elements.

The module and/or unit configuration shown in FIG. 1 is just an example of such, but however other module/unit configurations of the wellbore tractor 1 may also be just as suitable as the illustrated design on FIG. 1.

Figure 2:
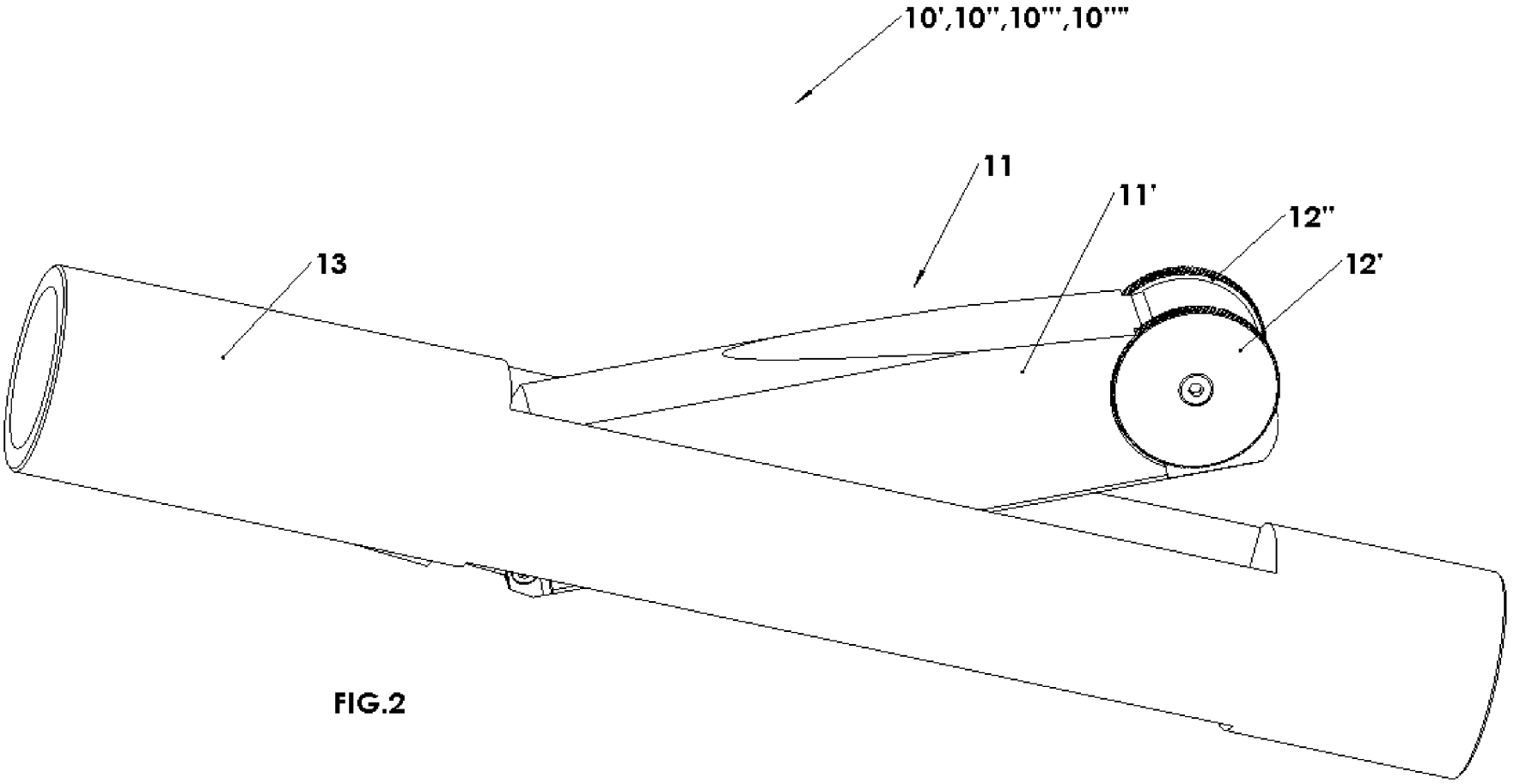
FIG. 2 shows in perspective an embodiment of a drive module for the wellbore tractor according to the present invention.

FIG. 2 shows a drive module 10', 10", 10''', 10'''' for the well tractor 1 according to the present invention. Each drive module 10', 10", 10''', 10'''' comprises a drive module housing 13.

Every drive module 10', 10", 10''', 10'''' has individual propulsion with a determined maximum pulling or tractive force or power, based on the motor and drive line capacity and the friction between the drive wheels 12', 12" and the pipe or casing wall (not shown). Hence, configuring a predetermined number of drive modules 10', 10", 10''', 10'''' in series can provide the required or desired total propulsion force capacity for the wellbore tractor 1.

The drive module 10', 10", 10''', 10'''' can move in both directions, wherein the drive wheels 12', 12" move in both directions of rotation with identical capacity and/or speed.

One drive wheel 12', 12" is arranged on each side of the drive unit 11. This increases the likelihood that at least one of the drive wheels 12', 12" of each drive module 10', 10", 10''', 10'''' always will be in contact with the casing or pipe when activated and running.

Figure 3A:
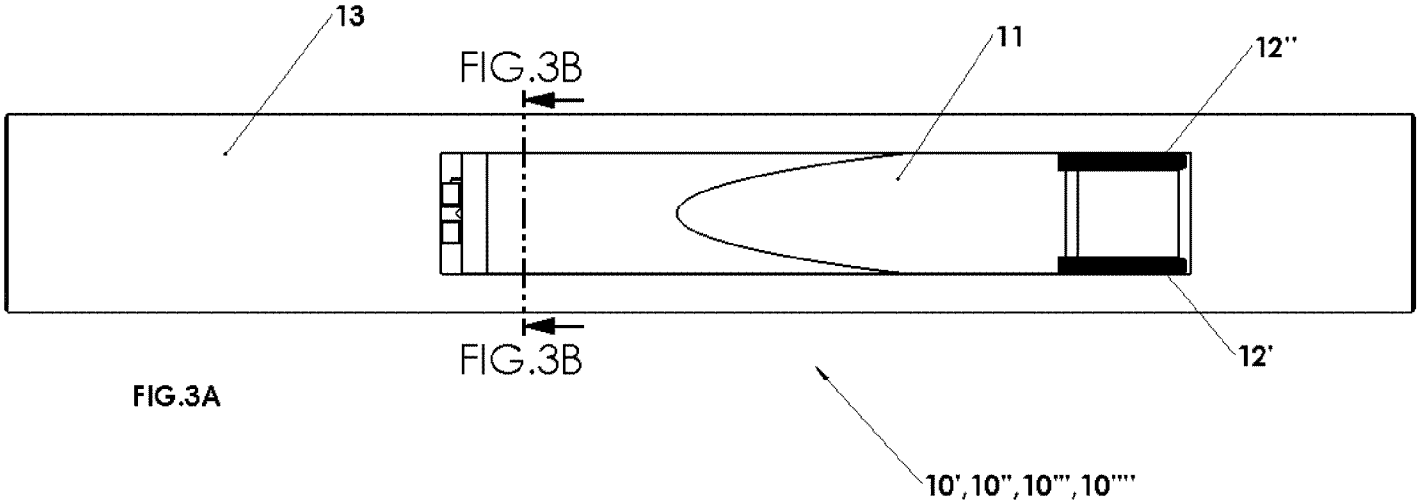
FIGS. 3A and 3B show respectively a view and a cross section of an embodiment of the drive module for the wellbore tractor according to the present invention.

FIG. 3A shows a view of the drive module 10', 10", 10''', 10'''' for the well tractor 1 according to the present invention. The drive unit 11 with wheel pair 12', 12" is shown positioned/arranged in a cavity/slot in the drive module housing 13.

Figure 3B:
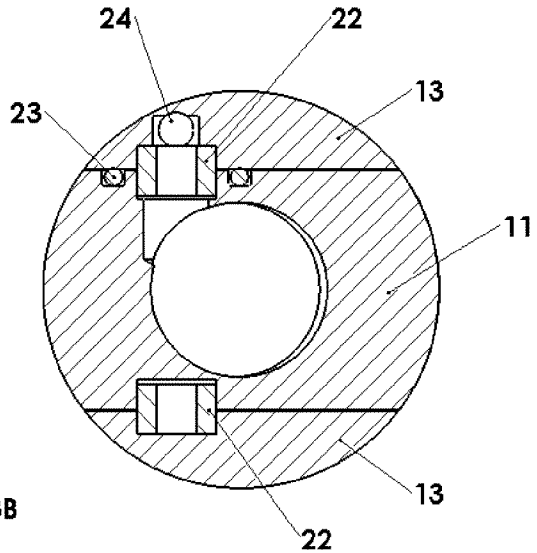

FIG. 3B shows a section view of the drive module 10', 10", 10''', 10''''. The bearings/bushings 22 serves as pivoting link for the drive unit 11 in the drive module. Wires from a power supply and the motor controller unit to the motor 16 (not shown in this figure) can be routed through the inner diameter of bearings/bushings 22 and further through the bore/channel 24. The inner diameter of bearings/bushings 22 and the bore/channel 24 also enables hydraulic communication between the motor chamber and/or the hydraulic pressure compensation chamber which may be in the hydraulics module 25. A seal ring 23 is located between the drive unit 11 and the drive module housing 13 positioned in such way that it can effectively serve as a barrier between the internal hydraulic fluid in the wellbore tractor 1 and the well fluids outside.

Figure 4A:
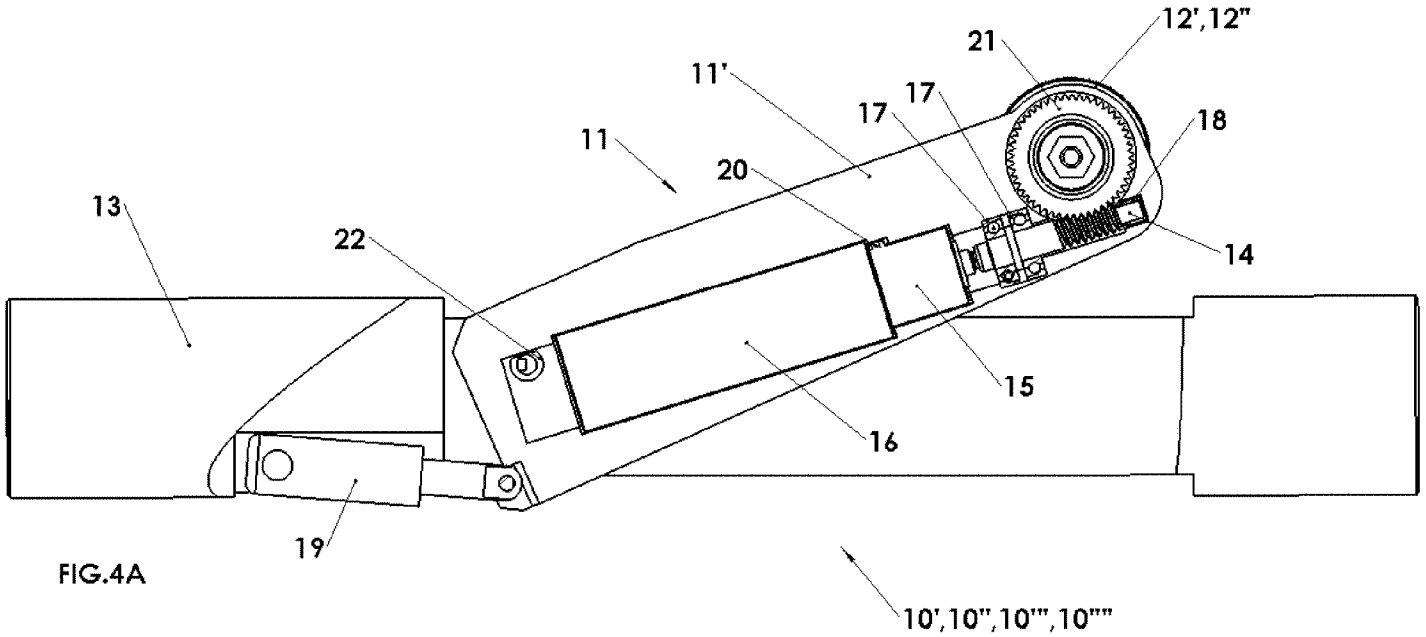
FIGS. 4A and 4B show different views of important drive line elements of the drive module for the wellbore tractor according to the present invention.
Figure 4B:
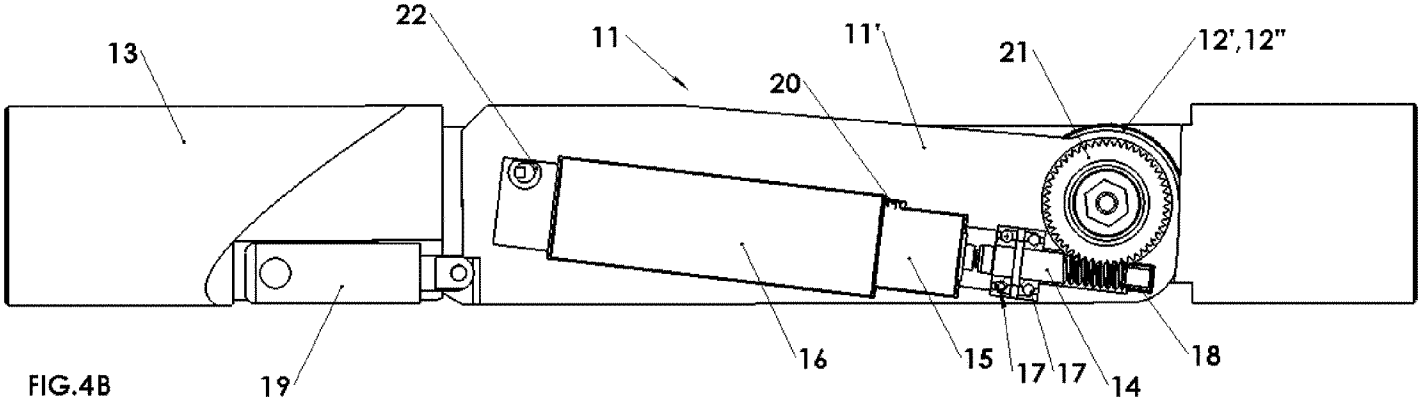

FIGS. 4A and 4B show a cross section of a drive module 10', 10", 10''', 10'''' for the well tractor 1 according to the present invention. Each drive module 10', 10", 10''', 10'''' comprises a drive unit 11, which again comprises a motor 16, e.g. an electrical motor, two drive wheels 12', 12" and a drive line arrangement comprising, between the motor 16 and the drive wheel(s) 12', 12", a reduction gear 15, a worm gear 14 and a worm wheel 21. Furthermore, there is shown bearings 17 and 18 for a worm and rotational locking element 20.

Depending on motor performance characteristics, the reduction gear 15 may be omitted if the motor 16 alone is capable of supplying the necessary/desired torque and rotational speed to drive the worm gear 14 directly.

The motor 16, reduction gear 15, worm gear 14 and worm wheel 21 may all have individual and separate lubrication to prevent spreading pollution between them. All chambers can be pressure equalized with the surroundings by external pressure equalization chambers.

The position of the drive unit 11/wheels 12', 12" may be manipulated using an adjustable pressure hydraulic actuator 19, e.g. an adjustable pressure hydraulic cylinder in order to reach the pipe or borehole or casing wall in which the wellbore tractor 1 is run.

Each hydraulic actuator 19 can be individually activated (extracted) or deactivated (retracted)/returned to its closed or resting position, if needed (e.g. in case of malfunction in the drive line arrangement in the corresponding drive unit 11).

The drive wheels' 12', 12" contact force on or against or towards the casing or pipe or borehole can then be adjusted in order to obtain a required or desired friction, simply by manipulating or changing the hydraulic cylinder's 19 pressure. Further, a very simple traction control arrangement or system may be implemented based on obtaining the required or desired friction by defining the hydraulic cylinder's 19 pressure as a function of the operator-set pull or push force for the well tractor 1. A computing unit may be connected in order to automatically regulate the hydraulic pressure to the hydraulic cylinder 19 based on the operator's pull or push force commands.

One possible design has a spring return function exerting continuous force on drive unit 11, wherein the drive unit 11 can be hinged to a single acting hydraulic actuator 19 and a retraction spring may be integrated in the hydraulic actuator (not shown). A retraction spring may also be installed separately outside the hydraulic actuator 19. An alternative design could be utilizing a double or dual acting hydraulic actuator 19, e.g. a double or dual motion hydraulic cylinder, providing for the hydraulic operation of the drive unit 11/drive wheels' 12', 12" position. Both designs provide for returning the drive unit 11/drive wheels 12', 12" in/to closed or resting position.

The hydraulic system or hydraulic actuator 19 for drive unit 11 position control is made to enable deactivating (pulling in) of each drive unit 11 (e.g. one or more) independently without any need for deactivation of other drive unit(s) 11. Drive unit 11 position deactivation/retraction can be done, if e.g. a drive line problem for a drive unit 11 is registered, or also if e.g. a special (changed) centralization of the wellbore tractor 1 in the well or pipe is desired or required. Such a function will be of significance when entering y-sections in/of the well or pipe. In a y-section a well tractor or runner should be able to change centering in order to enter or go further.

In order to control the drive wheels' 12', 12" rotation, speed and position, every drive module 10', 10", 10''', 10'''' can also comprise and/or utilize possible or required control components, means and/or systems, that all or partially can be arranged e.g. in the motor controller module.

Each drive wheel pair 12', 12" and/or motor 16 in the well tractor 1 can be controlled and operated independently. Despite that each drive module 10', 10", 10''', 10'''' is mechanically independent of the other drive module(s), it can be possible or necessary to connect them together or make them communicate together in order to synchronize rotation, speed, position, torque, force and/or other characteristics for one drive wheel pair 12', 12" with all the other drive wheels 12', 12", for all installed drive modules 10', 10", 10''', 10''''.

The motor 16 can be supplied with power through cable/wire line 28 (FIG. 1). The cable (line) or wireline 28 provides for supply of electric power and control and/or feedback signals to the wellbore tractor 1 and/or to the surface. The cable 28 is in addition used for pulling the wellbore tractor 1 out of the well under normal conditions. Such wirelines (e-lines) come from many manufacturers and with various constructions and/or sizes having thus varying strength and electrical capacity (depending on the number of conductors and/or the cross-section of the conductors). Most challenging is a cable with a single conductor when communication must be provided over the electrical power supply for the operation of the well tractor/runner. In addition, there is of course a limitation on the power transmission capacity of a cable due to the conductor cross-section and/or length of the cable and the fact that there are limitations on the permitted voltage that is to be applied to the cable. That is why the efficiency of the well tractor has a great practical significance. With the present low effective tractors, it is often necessary to cut or reduce the wireline length in order to be able to transfer the required electrical power, e.g. if there is an extra cable length to be cut or removed in accordance with the job or operational depth, where the problem will consequently be that a costly wireline or cable (line) has been damaged. This can be avoided by the higher efficiency of the wellbore tractor 1 according to the present invention. It is possible to go deeper and use the capacity of the tractor 1 according to the present invention without being constrained by the power transmission capacity.

The invention claimed is:

1. Drive module for a wellbore tractor, the drive module comprising:

a drive module housing; and a hydraulically actuated and pivoting drive unit including an arm housing and two drive wheels arranged thereto, wherein the drive wheels are driven by a motor mounted inside the arm housing, and wherein the drive wheels are drivingly connected to the motor via a drive line arrangement including, between the motor and the drive wheels, a worm gear drive arrangement including a worm gear and a worm wheel, and wherein the drive line arrangement further includes a reduction gear.

2. The drive module according to claim 1, wherein the reduction gear is a planetary reduction gear.

3. The drive module according to claim 1, further comprising a hydraulic actuator providing for manipulation of the drive unit pivoting position relative to the drive module housing.

4. The drive module according to claim 3, wherein a contact force of any one or both drive wheels against a casing or pipe or borehole is adjustable, for obtaining a required or desired traction, by manipulating the pressure of the hydraulic actuator.

5. The drive module according to claim 1, wherein the worm wheel of the worm gear drive arrangement is arranged between the two drive wheels.

6. The drive module according to claim 1, wherein the motor is an electrical motor.

7. A wellbore tractor comprising:

at least one drive module including:

a drive module housing; and a hydraulically actuated and pivoting drive unit including an arm housing and a pair of drive wheels arranged thereto, wherein the drive wheels are driven by a motor mounted inside the arm housing, and wherein the drive wheels are drivingly connected to the motor via a drive line arrangement including, between the motor and the drive wheels, a worm gear drive arrangement including a worm gear and a worm wheel, and wherein the drive line arrangement further includes a reduction gear.

8. The wellbore tractor according to claim 7, further comprising at least one of: a hydraulics module, an electronics module, a top end module or a bottom end module.

9. The wellbore tractor according to claim 8, wherein the electronics module comprises at least one of: a power supply unit, a telemetry unit, a motor controller unit or a tractor controller unit.

10. The wellbore tractor according to claim 8, wherein the hydraulics module is operatively configured to operate a hydraulic actuator providing for manipulating the position of the pair of drive wheels, the drive unit, or both the pair of drive wheels and the drive unit with respect to the drive module housing.

11. The wellbore tractor according to claim 7, wherein the at least one drive module further includes a plurality of drive modules, and further wherein each drive module's pair of drive wheels, the motor or both each drive module's pair of drive wheels and the motor are controlled and operated independently.

12. The wellbore tractor according to claim 7, wherein the at least one drive module further includes a plurality of drive modules, and further wherein each drive module's drive unit is individually retracted, individually extended or individually retracted and extended.

13. The wellbore tractor according to claim 7, wherein the at least one drive module further includes a plurality of drive modules, and further wherein all of the plurality of drive modules communicate together in order to synchronize at least one of rotation, speed, position, torque, or force for one drive wheel pair with all the other drive wheel pairs thereof.

14. The wellbore tractor according to claim 7, wherein the at least one drive module further includes a plurality of drive modules, and all drive units in the plurality of drive modules thereof have a predetermined angle or degree offset from each other, viewed in a section perpendicular to the longitudinal axis of the well tractor.

* * * * *